United States Patent [19]

Ellis et al.

[11] 4,187,060

[45] Feb. 5, 1980

[54] LIQUID FUEL INJECTION PUMPS

[75] Inventors: Arthur J. Ellis, Cheltenham; Alan Howarth, Churchdown, both of England

[73] Assignee: Lucas Industries Limited, Birmingham, England

[21] Appl. No.: 875,786

[22] Filed: Feb. 7, 1978

[30] Foreign Application Priority Data

Apr. 30, 1977 [GB] United Kingdom ..... 18174/77

[51] Int. Cl.[2] ..... F04B 7/04; F02M 59/44

[52] U.S. Cl. ..... 417/490; 123/139 AA

[58] Field of Search ..... 417/490, 494, 499, 501, 417/493; 123/139 AA, 139 AR, 139 AD, 139 AE, 139 R

[56] References Cited

U.S. PATENT DOCUMENTS 3,477,386 11/1969 Staudt ..... 417/490

FOREIGN PATENT DOCUMENTS 352966 7/1931 United Kingdom ..... 123/139 R

*Primary Examiner*—Leonard E. Smith

[57] ABSTRACT

A fuel injection pump includes a pumping plunger which is slidably mounted within a cylinder formed in a barrel. The barrel is provided with a pair of opposed ports which are covered by the plunger during its inward movement. The aforesaid ports permit fuel to flow into the pumping chamber when the plunger moves outwardly. Cavities can form in the fuel in the aforesaid ports prior to closure of the ports by the plunger and such cavities when they collapse can cause damage to the working surfaces of the plunger and cylinder. Channel means is provided to allow fuel to flow from the pumping chamber into at least one port to displace the cavities therefrom during the pumping stroke of the plunger.

6 Claims, 4 Drawing Figures

LIQUID FUEL INJECTION PUMPS

This invention relates to liquid fuel injection pumps of the kind comprising a reciprocable pumping plunger, a cylinder in which the plunger is slidable, the plunger extending from one end of the cylinder, means for effecting reciprocation of the plunger, an outlet from the other end of the cylinder and through which fuel is displaced from the pumping chamber during a pumping stroke of the plunger, a port formed in the wall of the cylinder and which is covered during the initial part of the pumping stroke of the plunger by the plunger, said port communicating with a fuel supply channel, fuel from said channel flowing into said cylinder by way of said port when the plunger uncovers said port.

Such pumps are well known in the art and can be constructed as a single pump housed in a body, or a plurality of such pumps may be mounted in a body.

Engine development is such that engines are becoming more powerful and are capable of operating at higher speeds. As a result the plunger velocity is increased and the effect is that the velocity of the fuel flowing through the port from the pumping chamber prior to the closure of the port by the plunger is also higher. In certain cases the velocity has now reached a value such that cavitation occurs in the fuel. Moreover, it has been found that the cavities thus formed in the fuel tend to remain in the port adjacent the side face of the plunger. The cavities will be collapsed when there is an increase in the fuel pressure in the supply channel and such collapse leads to the so-called cavitation erosion of the metallic surfaces.

The object of the invention is to provide a pump of the kind specified in a simple and convenient form.

According to the invention in a pump of the kind specified channel means is provided which communicates with the pumping chamber and which communicates with said port at least during part of the time the plunger is partaking of the pumping stroke, said channel means acting to convey fuel from the pumping chamber to said port to displace any cavities therein to said supply channel.

Three examples of fuel injection pumps in accordance with the invention will now be described with reference to the accompanying drawings in which.

Figure 1:
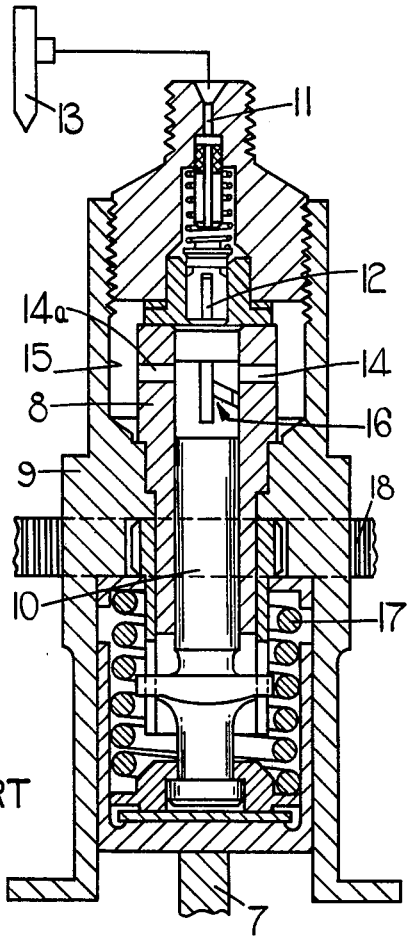
FIG. 1 PRIOR ART
FIG. 1 is a sectional side elevation showing a known form of pump.

With reference to FIG. 1 of the drawings there is provided a pump body 9 in which is mounted a pump barrel 8. The pump body defines a gallery 15 extending around the barrel 8 and the gallery is in communication with a fuel inlet (not shown) formed in the pump body. The fuel inlet in use is connected to a suitable source of fuel.

In the barrel is formed a cylinder which accommodates a reciprocable pumping plunger 10 and in use, the plunger is arranged to be moved inwardly by the action of a rotary cam 7 in timed relationship with an associated engine. The plunger is moved outwardly by the action of a coiled compression spring 17. During inward movement of the plunger fuel is displaced from the pumping chamber defined by the cylinder and the end of the plunger 10, past a non-return valve 12 to an outlet 11 and from the outlet to an injection nozzle 13 which is positioned on the associated engine. During outward movement of the plunger fuel is admitted to the pumping chamber through a pair of diametrical ports 14, 14*a* formed in the pump barrel and communicating with the aforesaid gallery. Fuel flows through the ports 14, 14*a* into the pumping chamber only when they are uncovered by the end of the pumping plunger.

In known manner the plunger 10 is provided with a helical or like groove 16 which defines an inclined edge and the groove 16 communicates with the pumping chamber. At some point during the inward movement of the plunger, the groove 16 is brought into communication with the port 14. This allows fuel to escape from the pumping chamber into the gallery 15 and the flow of fuel through the outlet 11 ceases. The relative angular setting of the plunger and the pump barrel can be adjusted in known manner so that the quantity of fuel delivered at each inward stroke of the plunger can be varied. As shown the plunger is movable angularly by means of a rack bar 18 which meshes with a pinion secured to a sleeve surrounding the pump barrel. The sleeve is provided with a pair of axial slots in which are located ears formed integrally with the plunger.

It will be understood that during the initial portion of the inward movement of the plunger fuel is being displaced from the pumping chamber by way of the ports 14 and 14*a*. The velocity of fuel flow through the ports increases as the plunger progressively covers the ports. Modern engines are operating at higher powers and increasing speeds with the result that the plunger velocity is also increased. It has been found that cavitation occurs within the ports 14 and 14*a*. The cavities which are produced by the cavitation tend to remain in the fuel in the ports but those which accumulate in the port 14 tend to be displaced outwardly into the gallery 15 when the port 14 is brought into register with the groove 16. As a result when collapse of those cavities occurs, it tends to take place in the fuel gallery well away from any accurately machined working surfaces of the pump. It has been shown however in practical tests that some minor erosion does occur due to some cavities collapsing in the port 14.

The cavities which accumulate in the port 14*a* can remain in the port until the latter is opened again by the plunger 10. As a result the cavities collapse whilst they are in close proximity to accurately machined surfaces and cavitation erosion takes place which results in much more extensive damage to the surfaces than in the case of the port 14. The cavities will be collapsed if there is any substantial increase in pressure within the gallery 15 and this can occur when the port 14 is uncovered to the groove and fuel rushes into the gallery from the pumping chamber. In this case the cavities will be collapsed whilst they are in the port and in close proximity to the side surface of the plunger. Furthermore, an increase of pressure may occur where the pump is one of a plurality of pumps in a common body, the increase in pressure taking place due to the fact that fuel is spilling from the pumping chamber of another pump.

In order to minimise the risk of cavitation erosion in the region of the ports in particular port 14*a*, it is proposed to promote a flow of fuel which displaces the cavities from the port into the gallery. For this purpose channel means is provided through which a restricted flow of fuel can take place from the pumping chamber to displace the cavities at least in the port 14*a*.

Figure 2:
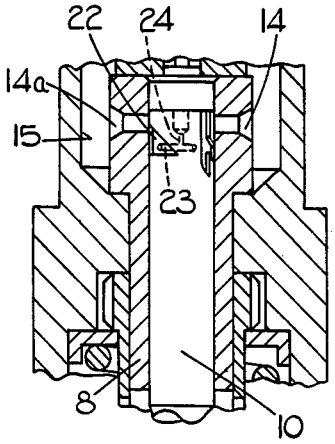
FIGS. 2 and 3 show various modifications to the pump of FIG. 1.

Referring now to FIG. 2 of the drawings it will be seen that in the wall of the plunger 10 there is formed a groove 22 which is brought into register with the port 14*a* during the inward movement of the plunger. Formed in the plunger is a passage 23 which at one end communicates with the groove 22 and which at its other end, communicates with the pumping chamber.

The groove 22 is formed in the surface of the plunger and conveniently the groove has an inclined leading edge so that the instant at which it communicates with the port 14*a* depends upon the relative angular setting of the plunger and the barrel. The passage 23 contains a restriction 24 so that the flow of fuel through the passage 23 and the groove 22 is very small but nevertheless sufficient to displace the aforesaid cavities. It will be appreciated that the above arrangement only effects displacement of the cavities in the port 14*a*.

Figure 3:
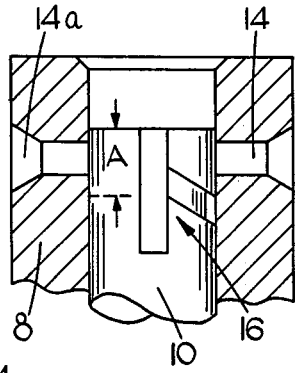

In the arrangement shown in FIG. 3 the flow of fuel is obtained by creating a leakage path between the plunger 10 and the cylinder. This is obtained in the preferred arrangement by reducing the diameter of the plunger however it is possible to increase the diameter of the cylinder or it is possible to modify both components.

As shown in FIG. 3 the diameter of the plunger is decreased over that length which is disposed above the helical edge of the groove 16 which uncovers the port 14. This length is indicated by the letter A in FIG. 3. In the case where the diameter of the cylinder is increased, the cylinder diameter is increased over that length of the cylinder above and including the ports 14, 14*a* which is swept by the end of the plunger.

The increase in diameter of the cylinder or the reduction in diameter of the plunger is such that the diametral clearance i.e. the difference between the plunger diameter and the cylinder diameter, is in the order of between one three thousandth part and two thousandth part of the nominal diameter of the plunger. If the clearance is too great then the pump output will be affected by an unacceptable amount. On the other hand if the clearance is too small than the cavities will not be displaced.

The flow of the fuel which takes place during the pumping stroke displaces the cavities from both ports 14 and 14*a* into the fuel supply channel and the risk of damage to the accurately machined surfaces of the plunger and cylinder is minimised.

Figure 4:
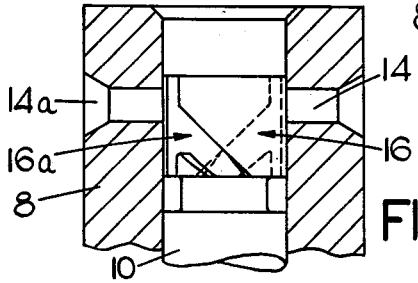
FIG. 4 shows a different form of pump.

In the example shown in FIG. 4 both ports 14 and 14*a* act as spill ports as well as filling ports. So that they can both act as spill ports the plunger is provided with a pair of grooves 16, 16*a*. The diametral clearance provided between the plunger and the wall of the cylinder is of the same order as in the preceding example.

We claim:

1. A liquid fuel injection pump of the kind comprising a reciprocable pumping plunger, a cylinder in which the plunger is slidable, the plunger extending from one end of the cylinder, means for effecting reciprocation of the plunger, an outlet from the other end of the cylinder and through which fuel is displaced from the pumping chamber during a pumping stroke of the plunger, a port formed in the wall of the cylinder and which is covered during the initial part of the pumping stroke of the plunger by the plunger, said port communicating with a fuel supply channel, fuel from said channel flowing into said cylinder by way of the port when the plunger uncovers said port, characterized by channel means defined by a clearance between the plunger and the cylinder provided by reducing the diameter of the plunger over that portion of the plunger between the end of the plunger in the pumping chamber, and groove means on said plunger, said channel means communicating with the pumping chamber and communicating with said port at least during part of the time the plunger is partaking of the pumping stroke, said channel means acting to convey fuel from the pumping chamber to said port to displace any cavities therein to said supply channel.

2. A liquid fuel injection pump of the kind comprising a reciprocable pumping plunger, a cylinder in which the plunger is slidable, the plunger extending from one end of the cylinder, means for effecting reciprocation of the plunger, an outlet from the other end of the cylinder and through which fuel is displaced from the pumping chamber during a pumping stroke of the plunger, a port formed in the wall of the cylinder and which is covered during the initial part of the pumping stroke of the plunger by the plunger, said port communicating with a fuel supply channel, fuel from said channel flowing into said cylinder by way of the port when the plunger uncovers said port, characterized by channel means defined by a clearance between the plunger and the cylinder provided by increasing the diameter of the cylinder over that portion of the cylinder which is swept by the end of the plunger, said channel means communicating with the pumping chamber and communicating with said port at least during part of the time the plunger is partaking of the pumping stroke, said channel means acting to convey fuel from the pumping chamber to said port to displace any cavities therein to said supply channel.

3. A liquid fuel injection pump of the kind comprising a reciprocable pumping plunger, a cylinder in which the plunger is slidable, the plunger extending from one end of the cylinder, means for effecting reciprocation of the plunger, an outlet from the other end of the cylinder and through which fuel is displaced from the pumping chamber during a pumping stroke of the plunger, a port formed in the wall of the cylinder and which is covered during the initial part of the pumping stroke of the plunger by the plunger, said port communicating with a fuel supply channel, fuel from said channel flowing into said cylinder by way of the port when the plunger uncovers said port, characterized by channel means defined by a diametral clearance between the plunger and the cylinder in the order of between one three thousandth part and one two thousandth part of the nominal plunger diameter, said channel means communicating with the pumping chamber and communicating with said port at least during part of the time the plunger is partaking of the pumping stroke, said channel means acting to convey fuel from the pumping chamber to said port to displace any cavities therein to said supply channel.

4. A liquid fuel injection pump of the kind comprising a reciprocal pumping plunger, a cylinder in which the plunger is slidable, the plunger extending from one end of the cylinder, means for effecting reciprocation of the plunger, a pair of ports formed in the wall of the cylinder, a fuel supply channel communicating with said ports, said ports being uncovered by said plunger as the plunger moves outwardly towards its outermost position to allow fuel into said cylinder, said ports being gradually covered by said plunger during the inward movement thereof, an outlet from the other end of said cylinder and through which fuel is displaced from the cylinder during further inward movement of the plunger after the ports have been covered, groove means defined in the plunger for registration with one of said ports towards the end of said further movement, the registration of said groove means with said one port terminating the flow of fuel through said outlet and allowing fuel to flow from the cylinder through said one port, this fuel flow acting to displace any cavities in the fuel within the one port into the supply channel, characterized by channel means which communicates with the cylinder and with said other port following the covering of said other port by the plunger, said channel means allowing a limited flow of fuel from said cylinder to flow through said other port to displace any cavities in the fuel in the other port into the supply channel before the ports are uncovered again by the plunger.

5. A pump according to claim 4, in which said channel means is formed by a groove on the plunger for registration with said port during the pumping stroke of the plunger, and restricted passage means extending between said groove and the pumping chamber.

6. A pump according to claim 5, in which said restricted passage means is formed by a passage in said plunger and a restrictor in said passage.

* * * * *